US007923933B2

(12) United States Patent
Serebryanov et al.

(10) Patent No.: US 7,923,933 B2
(45) Date of Patent: Apr. 12, 2011

(54) LAMP FAILURE DETECTOR

(75) Inventors: Oleg V. Serebryanov, San Jose, CA (US); Alexander Goldin, San Jose, CA (US); Joseph Michael Ranish, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1113 days.

(21) Appl. No.: 11/619,962

(22) Filed: Jan. 4, 2007

(65) Prior Publication Data

US 2008/0164822 A1 Jul. 10, 2008

(51) Int. Cl.
*H05B 39/10* (2006.01)
*G05F 1/00* (2006.01)

(52) U.S. Cl. ..... 315/90; 315/91; 315/291

(58) Field of Classification Search ..... 315/291, 315/312, 307, 224, 244, 7
See application file for complete search history.

(56) References Cited

U.S. PATENT DOCUMENTS

| | | | | |
|---|---|---|---|---|
| 5,397,963 | A * | 3/1995 | Manson | 315/129 |
| 5,952,832 | A | 9/1999 | Stevanovic et al. | |
| 6,337,544 | B1 * | 1/2002 | Wang et al. | 315/291 |
| 6,392,352 | B1 | 5/2002 | Walters et al. | |
| 6,784,667 | B2 * | 8/2004 | Belenger et al. | 324/414 |
| 7,109,668 | B2 * | 9/2006 | Pogodayev et al. | 315/307 |
| 7,173,216 | B2 * | 2/2007 | Ptak | 219/390 |
| 2003/0029859 | A1 | 2/2003 | Knoot et al. | |
| 2004/0026400 | A1 | 2/2004 | Ptak | |
| 2005/0077280 | A1 | 4/2005 | Ptak | |
| 2005/0286243 | A1 | 12/2005 | Ranish et al. | |
| 2006/0038661 | A1 * | 2/2006 | Reinhold et al. | 340/310.11 |
| 2006/0066193 | A1 | 3/2006 | Ranish et al. | |
| 2006/0086713 | A1 | 4/2006 | Hunter et al. | |

FOREIGN PATENT DOCUMENTS

| | | | |
|---|---|---|---|
| DE | 103 24 609 | A1 | 12/2004 |
| EP | 0 955 619 | A | 11/1999 |
| WO | WO 01/63976 | | 8/2001 |

OTHER PUBLICATIONS

International Search Report (EPO), May 8, 2008.

* cited by examiner

*Primary Examiner* — Douglas W Owens
*Assistant Examiner* — Minh D A
(74) *Attorney, Agent, or Firm* — Patterson & Sheridan, LLP

(57) ABSTRACT

An apparatus and method for detecting lamp failure is described for an array of lamps used in a rapid thermal processing system. The lamp failure detection system enables identification of a failed lamp among a plurality of lamps, and also provides identification of the failure type. The apparatus applies a lamp failure detection method to the voltage drop values measured across each lamp to determine if a lamp is in a failure state. In one embodiment, a field programmable gate array is used to apply a failure detection method to the lamp voltage values.

17 Claims, 18 Drawing Sheets

LAMP FAILURE DETECTOR

BACKGROUND OF THE INVENTION

1. Field of the Invention

Embodiments of the present invention generally relate to thermal processing of thin films on substrates such as a silicon wafers. In particular, embodiments of the invention relate to methods and apparatus used in detecting lamp failure for an array of lamps used to produce radiation for such thermal processing.

2. Description of the Related Art

Rapid thermal processing (RTP) is one thermal processing technique that allows rapid heating and cooling of a substrate such as a silicon wafer. Typical peak processing temperatures can range from about 450° C. to about 1100° C. and can be applied for about 15 to about 120 seconds before wafer cool down begins. The specific peak temperature and heating time used depend on the type of wafer processing. RTP wafer processing applications include annealing, dopant activation, rapid thermal oxidation, and silicidation among others. The rapid heating to relatively high temperatures followed by the rapid cooling that characterize RTP provides more precise wafer processing control. For example, RTP annealing following ion implantation of dopants allows repair of crystal damage while minimizing the diffusion of the dopant atoms due to the very short heating time. The crystal damage can be repaired before the implanted atoms can move from their original location. Other thermal processing techniques with longer heating and cooling cycles cannot achieve comparable dopant diffusion control during annealing.

The trend for thinner oxides used in MOS gates has led to requirements of oxide thicknesses less than 100 Angstroms for some device applications. Such thin oxides require very rapid heating and cooling of the wafer surface in an oxygen atmosphere to grow such a thin oxide layer. RTP systems can provide this level of control, and are used for rapid thermal oxidation processing. The technique of RTP uses the principle of radiation heating to allow rapid heating and cooling. Typically, this radiation is provided by many lamps placed in an array that is located above the wafer surface. The radiation from the many lamps heats the wafer surface and brings it up to process temperature in a matter of seconds. Since the lamps are electrically powered, they can be turned on and off quickly. The short heating time allows heating of the wafer surface without substantially heating the RTP chamber. This allows rapid cooling of the wafer surface when power to the lamps is turned off. The rapid heating and cooling cycle also reduces the thermal budget needed for the process. The reduced cycle time can also be used to decrease total processing time and increase wafer throughput. A result of the short heating cycle used in RTP is that any temperature gradients that may exist across the wafer surface can adversely affect wafer processing. It is, therefore, important in RTP to monitor the temperature across the wafer surface and ensure temperature uniformity in and on the wafer surface during processing. As a result, lamp placement and the control and monitoring of individual lamps are important so that the radiation output can be controlled to help ensure temperature uniformity across the wafer surface.

FIG. 1 shows a partially sectioned orthographic view of an RTP system 10. A silicon carbide wafer support ring 24 is supported on a rotating quartz cylinder 22. The wafer support ring has a pocket 32 into which a wafer (not shown) can be placed. A lamphead 14 faces the wafer support ring. The lamphead includes several hundred tungsten halogen lamps 26 that form an array of lamps which faces the wafer. A typical rating for such a lamp is in the range of 500 W to 650 W, and the tungsten halogen lamps emit strongly in the infrared. The bulb portion 42 of lamp 26 is shown in FIG. 3. The tubular bulb is typically made of quartz, filled with a halogen containing gas, and then sealed around two outer filament leads 50 and 52. A nose tip 46 remains after sealing. Enclosed within the sealed bulb is a tungsten filament 44 that is helically wound, with one end connected to a filament lead 52 and the other end connected to a side arm support 48. The most common mode of lamp failure is shorting of a few turns of the helical filament. Referring back to FIG. 1, each lamp is held in a stainless steel sleeve 16 potted into a water cooled stainless steel housing 18. The lamp bulbs extend beyond the sleeves 16 and the housing 18 into a front plate 30 which has an array of thru holes which match the lamp array. A reflector 20 is inserted into each thru hole. A thin quartz window 28 is located between the open end of the reflectors 20 and the chamber space 12 above the wafer.

FIG. 2 is another view of the front plate 30 which more clearly shows how the lamps may be arrayed. In this example, the lamps 26 are in a hexagonal array. The center lamp 26A is located on the wafer rotation axis 34. The wafer is rotated so that it will see a more uniform radiation distribution. The lamp array pattern plus wafer rotation is one approach to creating a more uniform distribution of radiation and temperatures across the wafer surface. However, this approach alone will not usually produce the temperature uniformity needed, and so typically the lamps may be controlled in concentrically arranged zones, for example, fifteen zones, such that the lamp power can be adjusted for each zone to compensate for thermal effects at the wafer center and edge to produce a more uniform radial temperature profile.

Variation in lamp intensity due to lamp failure or poor performance can greatly compromise the desired temperature profile control and result in unacceptable process results. Accordingly, a monitoring system that can detect lamp failure or unacceptable lamp performance prior to wafer processing is a useful feature for an RTP system. FIG. 4 is a schematic representation of a prior art lamp failure detection system for an RTP system. The lamps are powered by a silicon controlled rectifier (SCR) driver 60. The lamphead contains several hundred tungsten halogen lamps which are divided into multiple, radially symmetric zones, and each zone is separately powered by an SCR driver so that the lamp power can be adjusted for each zone. Each zone contains multiple lamps, and the lamps are divided into pairs with each lamp pair connected to the SCR driver. The two lamps of each pair are connected in series. In the present example, such a lamp pair is represented by lamps L1 and L2, which are included in a power distribution board 64. The power distribution board contains all lamps in the lamphead, but only a single lamp pair is shown since the same lamp failure detection circuit is applied to each lamp pair. The power distribution board which includes lamps L1 and L2 is connected to a lamp failure detection (LFD) board 62. The LFD board includes a current transformer sensor 66 which is magnetically coupled to a conducting line 68 so that the current passing through lamps L1 and L2 can be measured. The conducting line 68 may be a printed circuit board trace. The sensor is connected to a comparator 74 which can compare the current measured to a pre-set threshold value to determine if a failure condition exists. In this example, a failure condition would be detected if the measured current were less than the threshold current value. This information is then sent to an operator display screen which identifies the particular lamp pair that is in a failure state. For example, if the lamp L2 filament were to break, this open filament condition would create an open circuit and result in zero current flow through lamps L1 and L2. The current sensor would then detect a lamp failure state.

The lamp failure detection system shown in FIG. 4 has several limitations. If one of the lamp filaments breaks, the system cannot detect which lamp L1 or L2 has the open filament since the failure detection method measures current for two lamps connected in series. As a result, it is necessary to check both lamps for failure if a failure state is indicated for the lamp pair. Also, the lamps for a given pair are often located at some distance apart within the lamphead to minimize the impact to radiation uniformity should one of the lamps fail during wafer processing. Significant time could be saved if only the failed lamp had to be located within the lamp array, resulting in decreased down time for the RTP system.

Another limitation of the prior system is that it cannot detect different types of lamp failure. The use of current measurement to detect lamp failure for two lamps in series has inherent limitations since the measured current value is a result of the combined resistance of both lamps. If one of the lamp filaments is open, then the absence of current will trigger a failure signal since the current is now below the threshold value. It is also possible that a lamp may have a partial short which would decrease the lamp resistance and increase the current measured by the sensor. This would not trigger a failure signal since the current would remain above the threshold value. A lamp with a partial short will tend to have a radiation output that differs from the output of a normal lamp. The change in radiation output could adversely effect wafer processing. In the case of an incandescent light source such as a tungsten halogen lamp, a partial short can occur from the shorting of a few turns of the helical filament, which will typically alter the lamp radiation output and shorten the lamp lifetime.

An additional limitation of the prior system is suggested by the current waveforms shown for sensor input 70 and sensor output 72 for normal lamp operating conditions. The current transformer 66 has a minimum threshold value for current rate-of-change. If the input signal waveform has a rate-of-change that is below this threshold value, the current sensor will not function. This implies that the voltage and current waveforms must meet certain requirements in order to use the current transformer 66 for detecting current. The input waveform 70 does meet such requirements; a low frequency sinewave, for example, may not. Also, because the current sensor 66 is magnetically coupled to conducting line 68, the sensor is susceptible to any noise created by stray electromagnetic fields near the RTP system. This noise can degrade the accuracy of current measurement, and hence the accuracy of the lamp failure detection system.

Therefore, there is a need for an improved apparatus and method for lamp failure detection. It would be useful to have a lamp failure detection system that is independent of voltage and current waveforms, and can function accurately and reliably in the presence of stray electromagnetic fields. Also, it would be useful to have a failure detection system that can identify which lamp has failed, and identify the type of failure, such as a partial short. More generally, it would be useful to have a failure detection system which can detect any deviation from the normal operating characteristics of a lamp. Such information can be used to reduce system downtime as well as help prevent lamp failure during wafer processing.

SUMMARY OF THE INVENTION

Aspects of the invention provide a lamp failure detection apparatus for detecting lamp failure in an array of lamps used for thermal processing of semiconductor substrates. The apparatus includes: a data acquisition (DAQ) module to sample voltage signals at different sampling locations along a circuit path formed by a group of serially connected lamps in the array; and a controller adapted to detect a failure in one or more of the lamps based on voltage drops across at least two of the lamps, as determined by the sampled voltage signals.

Another aspect of the invention provides a lamp failure detection system for detecting lamp failure in an array of lamps used for thermal processing of semiconductor substrates. The system includes: a multiplexor for receiving a plurality of analog voltage signals sampled from different locations along circuit paths formed by groups of serially connected lamps in the array; an analog to digital (A/D) converter to provide digital values corresponding to one or more of the analog voltage signals output by the multiplexor; and control logic adapted to control the multiplexor to select which analog voltage signals are output by the mutliplexor and, for multiple groups of serially connected lamps in the array, to detect a failure in one or more of the lamps of the group based on voltage drops across at least two of the lamps, as determined by the sampled voltage signals.

In another aspect of the invention, a method is provided for detecting lamp failure in an array of lamps used for thermal processing of semiconductor substrates. The method includes: sampling voltage signals at different sampling locations along a circuit path formed by a group of serially connected lamps in the array; calculating voltage drops across at least two of the lamps based on the sampled voltage signals; and determining the presence or absence of a failure based on a relationship between the voltage drops.

DETAILED DESCRIPTION

Below are described several embodiments of a lamp failure detection system and a corresponding method. The method uses voltage measurements, and has the advantage of allowing identification of which lamp has failed, and the type of failure. A system utilizing this method is simpler, more reliable, and more accurate than the prior art system.

Figure 1:
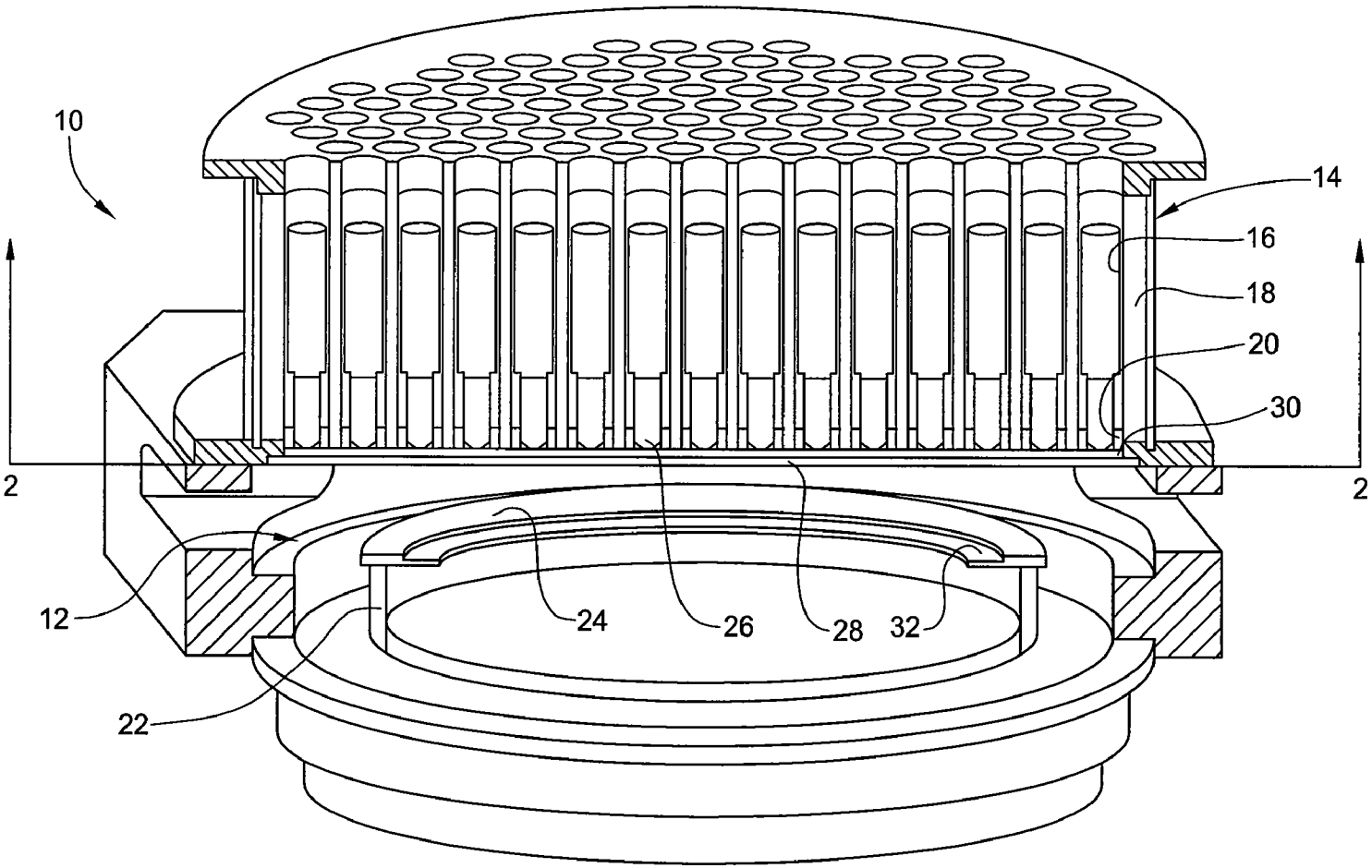
FIG. 1 (PRIOR ART)
FIG. 1 is a cut-away orthographic view of a thermal processing chamber.
Figure 2:
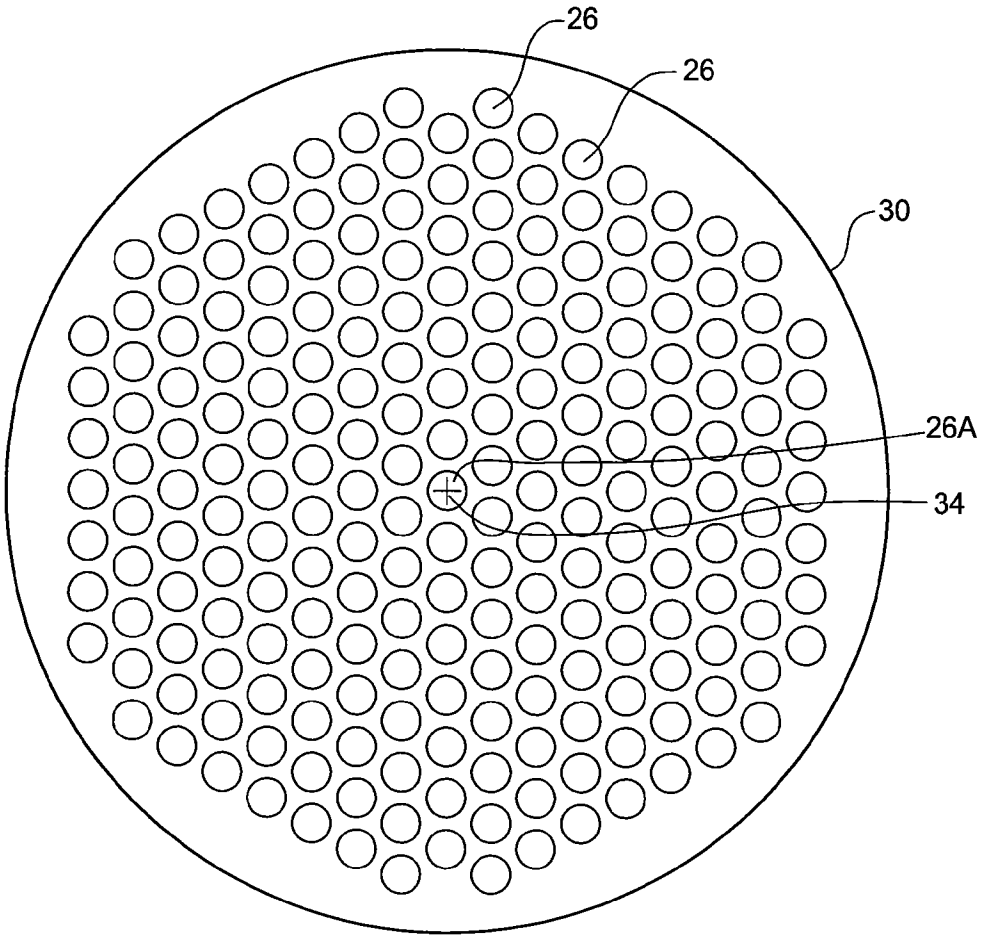
FIG. 2 (PRIOR ART)
FIG. 2 is a bottom view of a lamphead.
Figure 3:
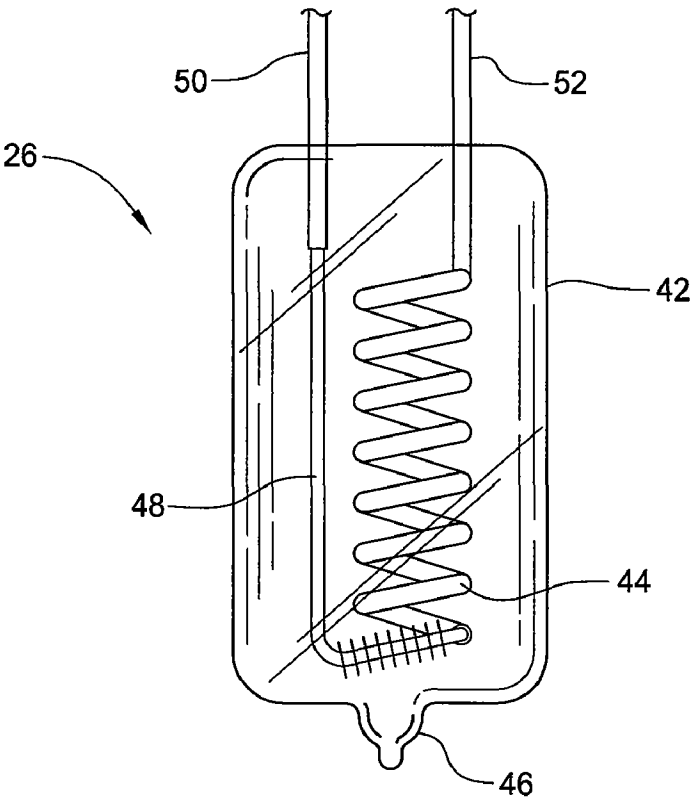
FIG. 3 (PRIOR ART)
FIG. 3 illustrates an exemplary lamp bulb in a lamphead.
Figure 4:
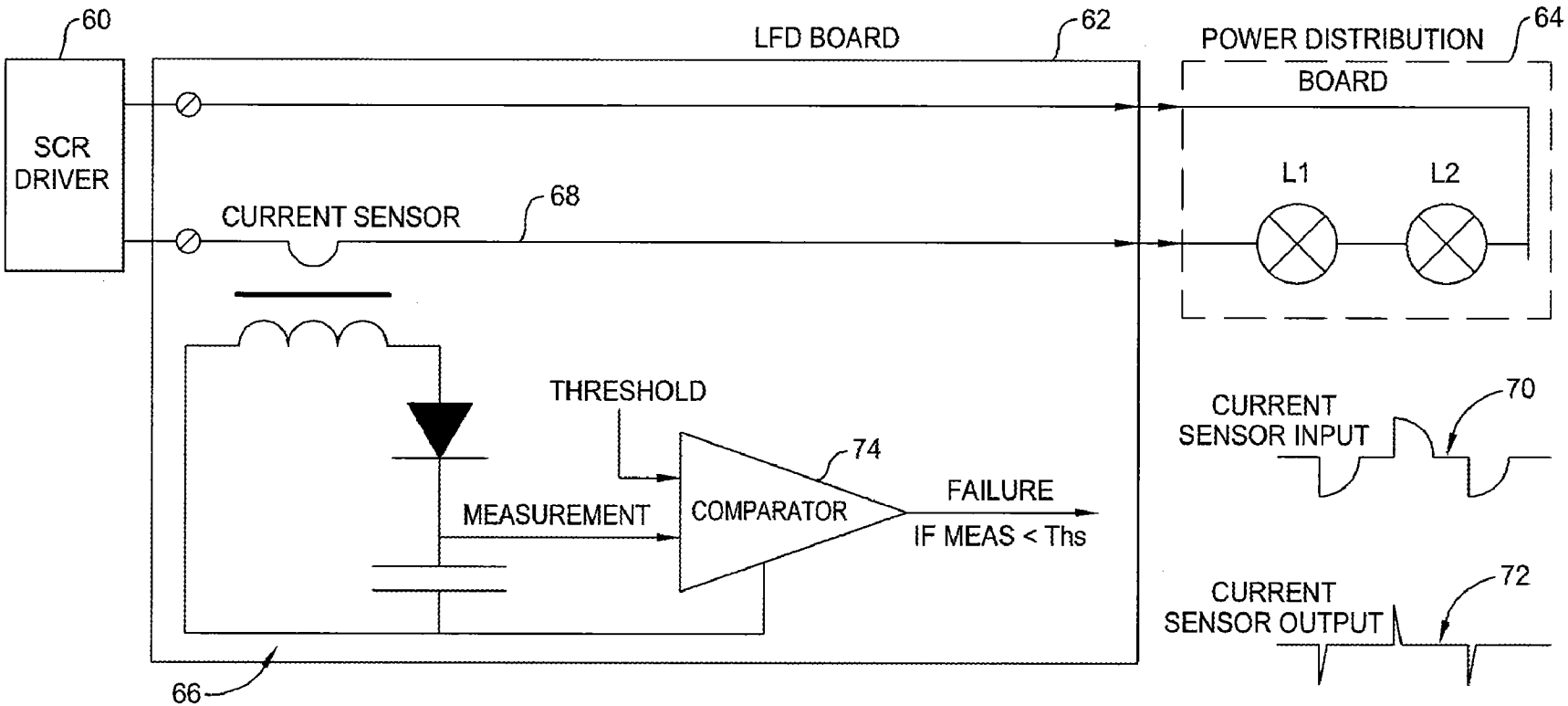
FIG. 4 (PRIOR ART)
FIG. 4 is a schematic view of a prior art lamp failure detection system.
Figure 5:
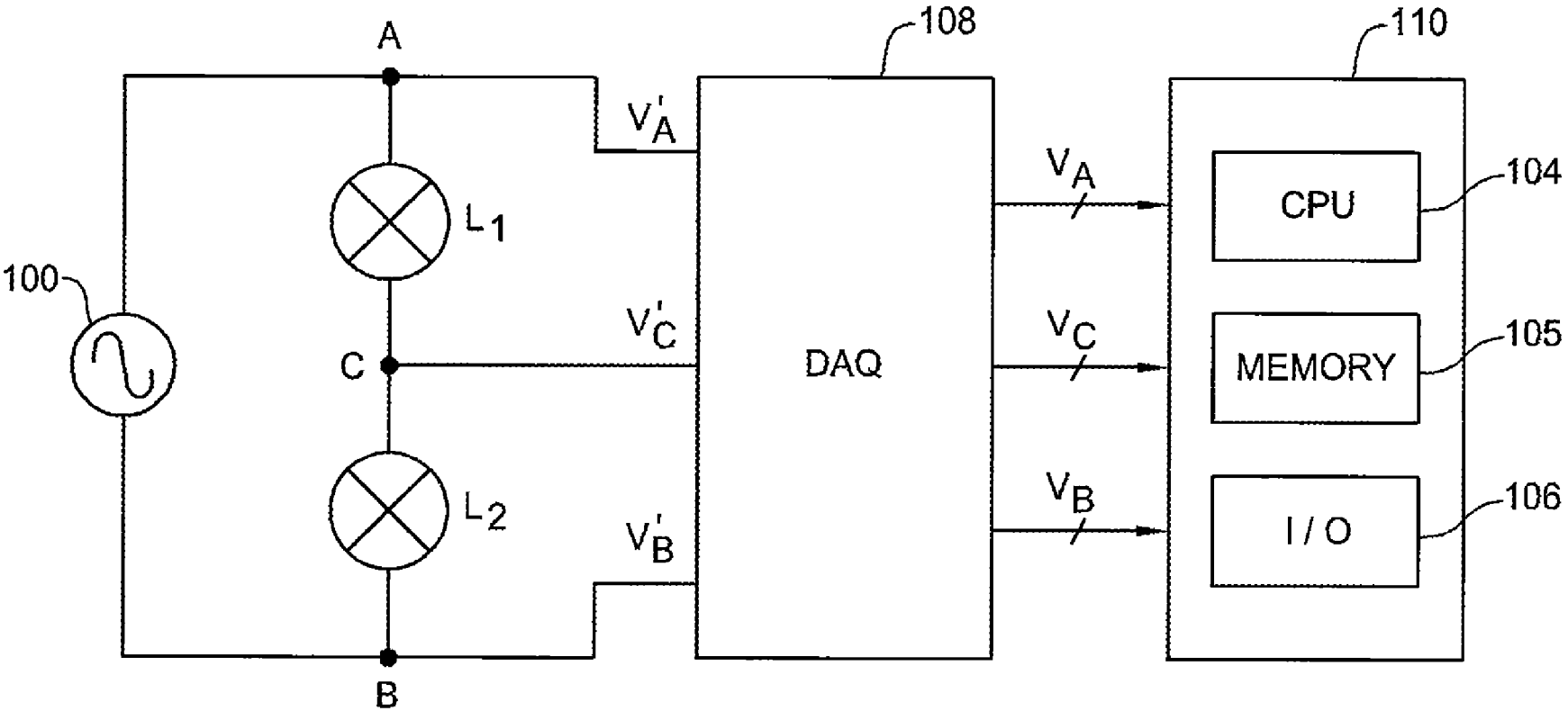
FIG. 5 is a block diagram of one embodiment of a lamp failure detector.

One embodiment of a lamp failure detection system is shown in FIG. 5. A lamphead typically contains several hundred tungsten halogen lamps which are divided into multiple, radially symmetric zones, and each zone is separately powered by an SCR driver so that the lamp power can be adjusted for each zone. Within each zone are multiple lamps, and the lamps are typically divided into pairs with each lamp pair connected to the SCR driver. The two lamps of each pair are connected in series.

FIG. 5 shows one lamp pair. Although only one lamp pair is shown, multiple lamp pairs may be connected in parallel with the same power supply, and the same failure detection system and method may be used for each lamp pair so long as the circuitry used will allow measurement of the voltage drop across each lamp in each lamp pair. Referring back to FIG. 5, two lamps L1 and L2 are connected in series with a power supply 100. In this example, the power supply is AC, but could also be a DC supply. In the present example, the source is AC and may include any suitable circuitry, such as a silicon controlled rectifier (SCR) driver.

A data acquisition device (DAQ) 108 is used to take voltage measurements at points A, B, and C. The data acquisition device 108 may include any suitable circuitry such as a multiplexer (MUX) and analog-to-digital converter (ADC). The ADC converts the analog voltage inputs $V'_A$, $V'_B$, and $V'_C$ to digital values $V_A$, $V_B$, and $V_C$ which are sent to a controller 110 where the voltage drops across each lamp are determined. In this example, the voltage drop across lamp L1 is $V_A-V_C=V_{L1}$, and the voltage drop across lamp L2 is $V_C-V_B=V_{L2}$. The controller applies the voltage drop values $V_{L1}$ and $V_{L2}$ to a set of conditionals to determine if either lamp is in a failure state. This process may be repeated for each lamp pair in a zone, and for each zone of the lamp array.

The controller 110 may include any suitable components, such as a central processing unit (CPU) 104, memory 105, and support circuits (I/O) 106. The CPU 104 may be any form of computer processor that can control and/or monitor lamp operation. The memory 105 may be of any type such that software instructions and data can be coded and stored within the memory 105 for execution by the CPU 104. The support circuits 106 may include, for example, power supplies, input/output circuitry, analog-to-digital converters, and the like.

FIGS. 6A-6F show how the voltage drops across each lamp are used to determine if a lamp is in a failure state, and the type of failure state. $V_1$ and $V_2$ represent the measured digital voltage drop values for lamps L1 and L2, respectively. In each circuit represented by FIGS. 6A-6F, an AC voltage V' is applied to the lamp pair, and the corresponding digital voltage is V. Phases øA and øB indicate that the power source is three phase AC, and the lamp pair is connected across the line-to-line voltage of these two phases.

In the lamp failure detection method described in FIGS. 6A-6F, a lamp is assumed to be in one of three states: an open state; a closed or normal state; or a partially shorted state. An open state indicates that the internal lamp circuit is open and no current can flow through the lamp. In the case of an incandescent lamp, a broken filament would cause an open lamp state. A closed state means that the internal lamp circuit is closed and current can flow through the lamp as in the case of normal lamp operation. For a lamp that is partially shorted, the lamp resistance is below its normal value, and this will cause a decrease in the voltage drop across lamp, but the voltage drop will remain nonzero. A completely shorted lamp would represent the limiting case where the lamp resistance went to zero, and the voltage drop across the lamp would also go to zero. However, the state of a completely shorted lamp is not included in the present embodiment of this method for two reasons. Firstly, the most common lamp failure modes are the open or partially shorted states, and a completely shorted lamp is unlikely. Typically, a shorted lamp has sufficient resistance to produce a nonzero and measurable voltage drop. Secondly, if a lamp were to be completely shorted, the overall decrease in resistance for the two lamps in series would typically result in a current magnitude that would overload the remaining good lamp and cause it to go into an open state. Therefore, for the present embodiment, a zero voltage drop across a lamp implies that no current is flowing through the lamp, and not that the lamp is completely shorted.

Figure 6A:
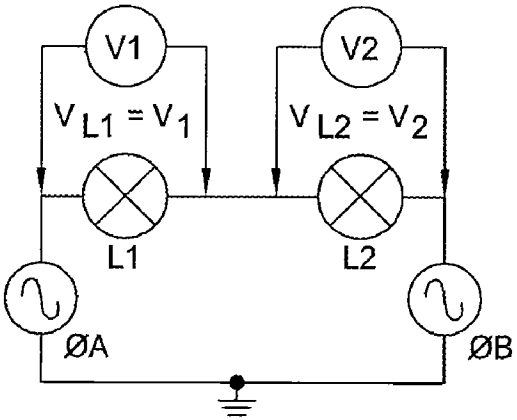
FIGS. 6A-6F are schematic views depicting lamp operation.

FIG. 6A shows the state where both lamps L1 and L2 are in a normal operating state. The voltage across L1 has a nonzero value $V_1$, and the voltage across L2 has a nonzero value $V_2$. The condition of normal operation for both lamps can be expressed as follows: If $V_{L1}\neq 0$ and $V_{L2}\neq 0$ and $|V_{L1}-V_{L2}|\leqq\alpha$, then L1 and L2 are normal. Here, $\alpha$ represents a differential voltage threshold value which is used to define a state of normal lamp operation. This threshold value is typically selected based on experience with types of lamps used and variations allowable. In the case of rapid thermal processing (RTP), the allowable threshold may be less than 5 percent of the average voltage across each lamp. Alternatively, if $V_{L1}\neq 0$ and $V_{L2}\neq 0$ and $|V_{L1}-V_{L2}|>\alpha$, then L1 and L2 are not in a normal operating state, and a failure state can be defined for the lamp pair.

Figure 6B:
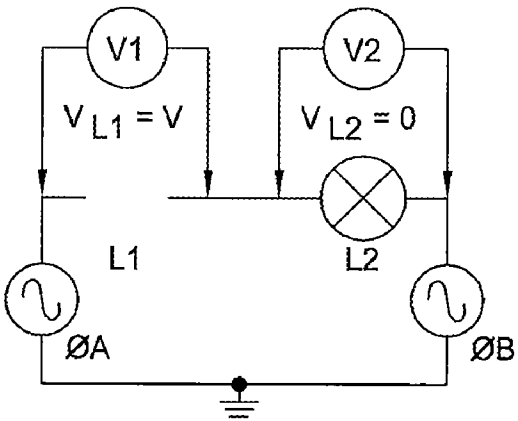

In FIG. 6B, lamp L1 is in an open state and lamp L2 is in a closed and normal state. This situation will produce the voltage measurements shown. The voltage across L2 will be zero since there is no longer a complete circuit to allow current flow through the lamps. But since L2 is not open, the voltage measured across L1 will now have the value V which is the voltage normally applied to the lamp pair. This condition can be expressed as: If $V_{L1}\neq 0$ and $V_{L2}=0$, then L1 is open and L2 is closed. A failure state for lamp L1 exists, and a signal can be sent to a display screen to identify which lamp of the L1 and L2 pair has failed. Note that $V_{L1}=V$ could have been used in place of $V_{L1}\neq 0$ in the if-then statement above, but $V_{L1}\neq 0$ simplifies the statement without changing the conclusion that L1 is open. Additionally, the if-then statement can be further shortened to: If $V_{L2}=0$, then L1 is open. This statement does not indicate the status of L2, but is always true when L1 is open.

Figure 6C:
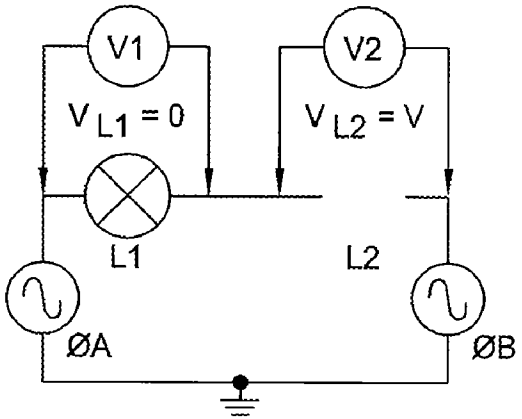

FIG. 6C shows the case where lamp L2 is in an open state and lamp L1 is in a closed state, which is similar to the situation described above. This condition can be expressed as: If $V_{L1}=0$ and $V_{L2}\neq 0$, then L2 is open and L1 is closed. Additionally, the if-then statement can be further shortened to: If $V_{L1}=0$, then L2 is open.

Figure 6D:
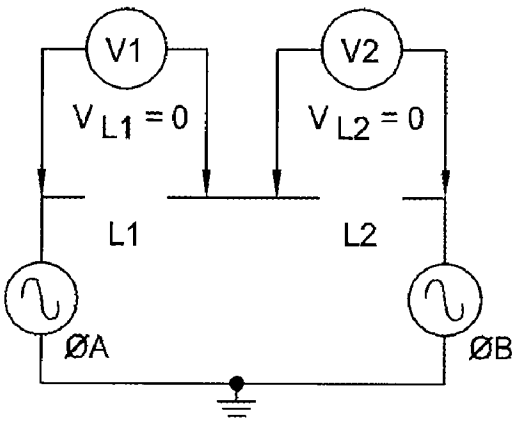

In FIG. 6D, both lamps L1 and L2 are in an open state. For some embodiments, such as shown in FIG. 6D, the lamp failure detection system may be designed in the event of open circuits to provide zero voltage readings. In this case, the voltages shown across each lamp L1 and L2 are zero when both lamps are open. The condition for both lamps in an open state can be expressed as: If $V_{L1}=0$ and $V_{L2}=0$, then L1 and L2 are open. In other embodiments, the lamp failure detection system may be designed to indicate that an open circuit has been detected when both lamps are open, and not provide zero voltage readings.

Figure 6E:
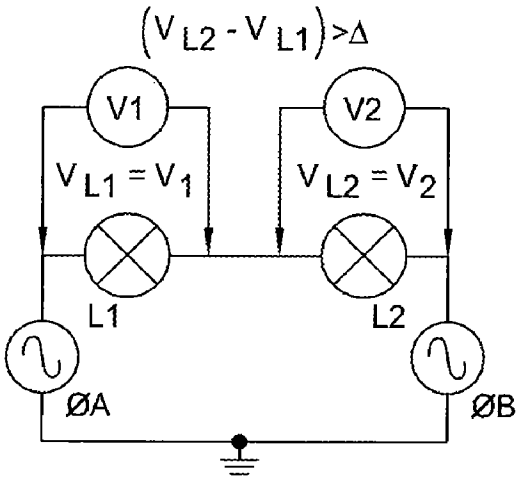

Another failure state is possible for the lamp pair. In FIG. 6E, lamp L1 has a partial internal short, and lamp L2 is normal. In this case, neither lamp L1 nor L2 are in an open state and each lamp will have a nonzero voltage drop. It can be appreciated that a partial short in lamp L1 will reduce the lamp resistance below its normal value, and this will cause a decrease in the voltage drop across lamp L1. This observation suggests that a partial internal short in one lamp will increase the difference between voltage drops for each lamp beyond the value one would expect for normal lamp operation. This state can be represented by a conditional where the difference in voltages $V_{L2}$ and $V_{L1}$ is compared to a differential voltage threshold value. If this difference exceeds the threshold value, then an unacceptable partial short condition is identified for lamp L1 and a failure state exists. This conditional can be expressed as: If $V_{L1}\neq 0$ and $V_{L2}\neq 0$ and $(V_{L2}-V_{L1})>\Delta$, then lamp L1 has a partial short. The choice of differential voltage threshold value $\Delta$ will depend on the allowable variation in lamp intensities, but may be less than 8 percent of the average voltage across each lamp for application to RTP. Additionally, the if-then statement can be further shortened to: If $(V_{L2}-V_{L1})>\Delta$, then lamp L1 has a partial short. If either $V_{L1}=0$ or $V_{L2}=0$, then a lamp is open and a failure state will be detected.

Figure 6F:
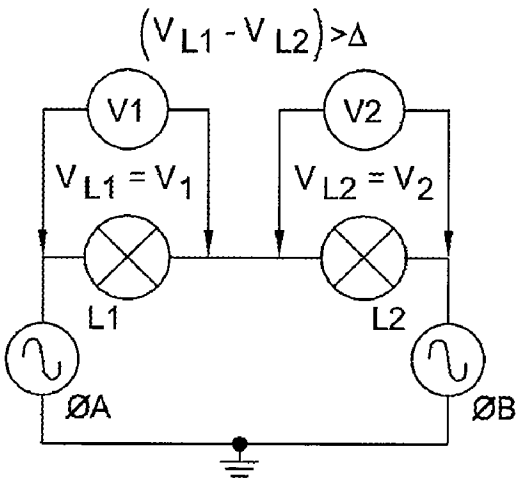

FIG. 6F shows the case where lamp L2 has a partial short and lamp L1 is normal. Similar reasoning applies here as for the previous failure state. The conditional can be expressed as: If $V_{L1}\neq 0$ and $V_{L2}\neq 0$ and $(V_{L1}-V_{L2})>\Delta$, then lamp L2 has a partial short. The same threshold value $\Delta$ used in the case above could apply here, and the if-then statement can be further shortened to: If $(V_{L1}-V_{L2})>\Delta$, then lamp L2 has a partial short.

Figure 7:
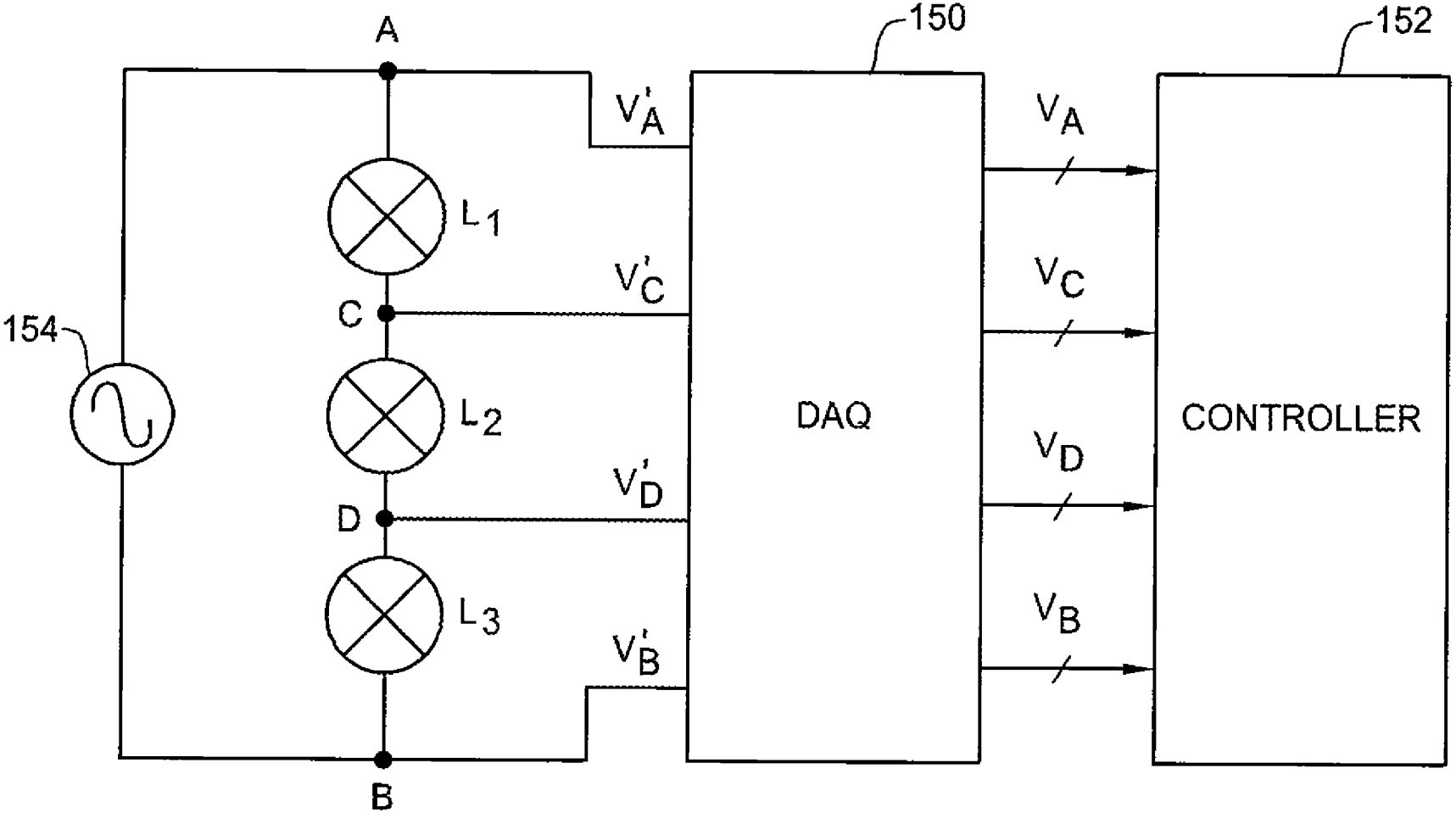
FIG. 7 is a block diagram of another embodiment of a lamp failure detector.

FIG. 7 is another embodiment for a lamp failure detection system when there are three lamps in series. It is to be appreciated however, that the present embodiment may be used with more than three lamps, as long as there is sufficient voltage supply to operate the lamps of the system. The lamphead contains several hundred tungsten halogen lamps which are divided into multiple, radially symmetric zones, and each zone is separately powered by an SCR driver so that the lamp power can be adjusted for each zone. Within each zone are multiple lamps, and the lamps are divided into groups of (in this example) three lamps with each lamp group connected to the SCR driver. The three lamps of each group are connected in series.

FIG. 7 shows one lamp group. The lamps L1, L2, and L3 are connected in series with a power supply 154. As before, the power supply is AC, but could also be a DC supply. In this example, the source is AC and represents a silicon controlled rectifier (SCR) driver. A data acquisition device (DAQ) 150 is connected to the circuit as shown to take voltage measurements at points A, B, C, and D. The ADC converts the analog voltage inputs $V'_A$, $V'_B$, $V'_C$, and $V'_D$ to digital values $V_A$, $V_B$, $V_C$, and $V_D$ for all lamps in the series. These values are sent to a controller 152 where the voltage drops across each lamp are determined. In this example, the voltage drop across lamp L1 is $V_A-V_C=V_{L1}$, the voltage drop across lamp L2 is $V_C-V_D=V_{L2}$, and the voltage drop across the lamp L3 is $V_D-V_B=V_{L3}$.

The controller 152 applies the voltage drop values $V_{L1}$, $V_{L2}$, and $V_{L3}$ to a set of conditionals to determine if a lamp is in a failure state. This process is repeated for each lamp group in a zone, and for each zone of the lamp array.

FIGS. 8A-8E show how the voltage drops across each lamp are used to determine if a lamp is in a failure state, and the type of failure state. $V_1$, $V_2$ and $V_3$ represent the measured digital voltage drop values for lamps L1, L2, and L3 respectively. In each circuit represented by FIGS. 8A-8E, an AC voltage V' is applied to the lamp group, and the corresponding digital voltage is V. Phases øA and øB indicate that the power source is three phase AC, and the lamp series is connected across the line-to-line voltage of these two phases. As mentioned previously for the two lamp case, and for similar reasons, a zero voltage drop across a lamp implies that no current is flowing through the lamp, and not that the lamp is completely shorted.

Figure 8A:
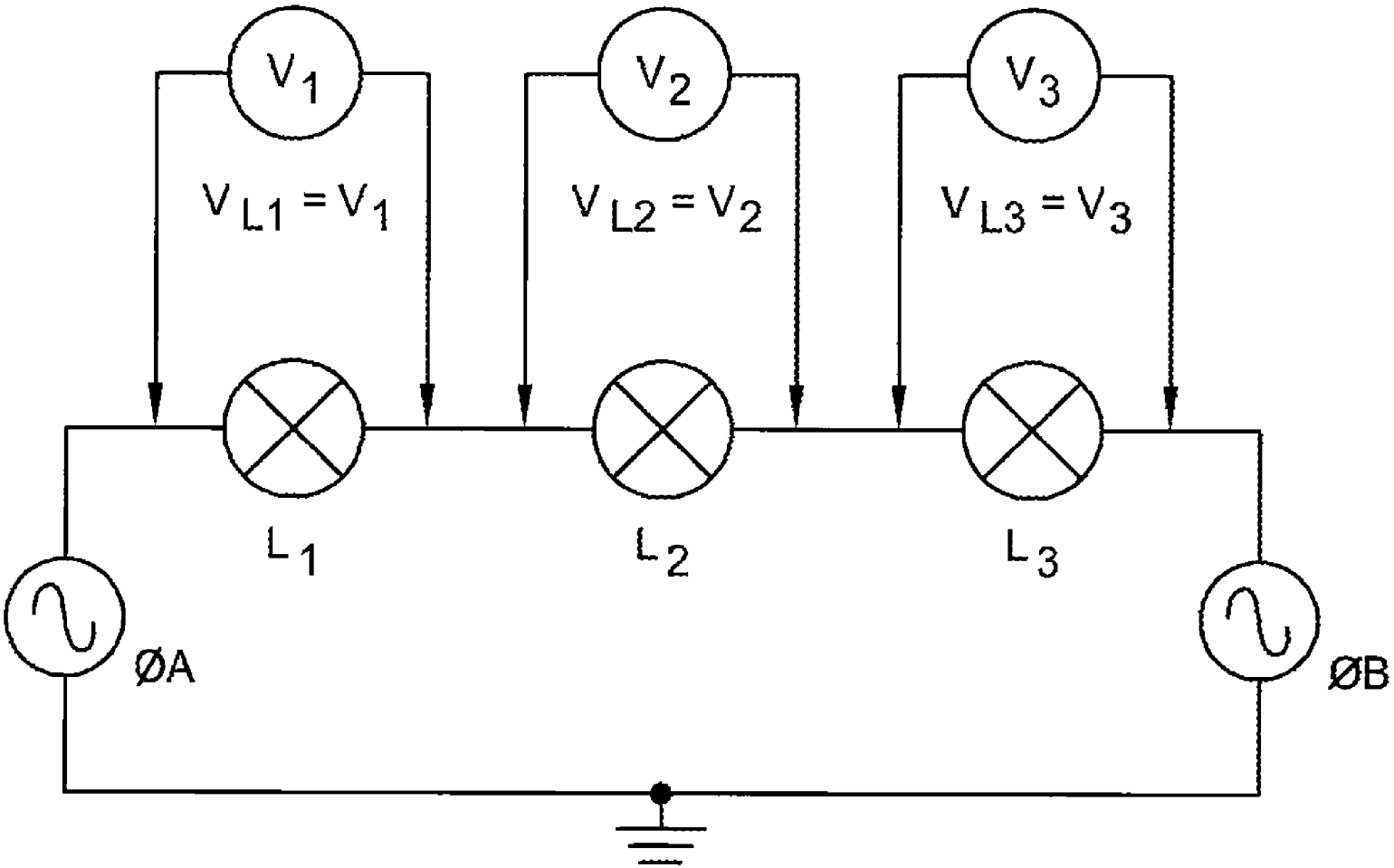
FIGS. 8A-8E are schematic views depicting lamp operation.

FIG. 8A shows the state where all lamps are in a normal operating state. The voltage across L1 has a nonzero value $V_1$, the voltage across L2 has a nonzero value $V_2$, and the voltage across L3 has nonzero value $V_3$. The condition of normal operation for all lamps can be expressed as follows: If each lamp in the series has a nonzero voltage value, and the magnitudes of the voltage differences between adjacent lamp pairs are less than or equal to some threshold value, then all the lamps are normal. For example, if $|V_{L1}-V_{L2}|\leqq\alpha$ and $|V_{L2}-V_{L3}|\leqq\alpha$, then lamps L1, L2, and L3 are normal. In other embodiments, the failure detection method may also include the magnitudes of the voltage differences between non-adjacent lamp pairs. For example, if $|V_{L1}-V_{L3}|\leqq\alpha$, then lamps L1 and L3 are normal. As in the two lamp case, $\alpha$ represents a differential voltage threshold value which is used to define a state of normal lamp operation. This threshold value is typically selected based on experience with types of lamps used and variations allowable. In the case of RTP, the allowable threshold may be less than 5 percent of the average voltage across each lamp. If two adjacent lamps in the series have nonzero voltage values, and the magnitude of the voltage difference for this pair is greater than this threshold value, then the lamps are not in a normal operating state, and a failure state can be defined for the lamp pair. For example, if $|V_{L1}-V_{L2}|>\alpha$, then lamps L1 and L2 are not in a normal operating state and a failure state can be defined for the lamp pair.

Figure 8B:
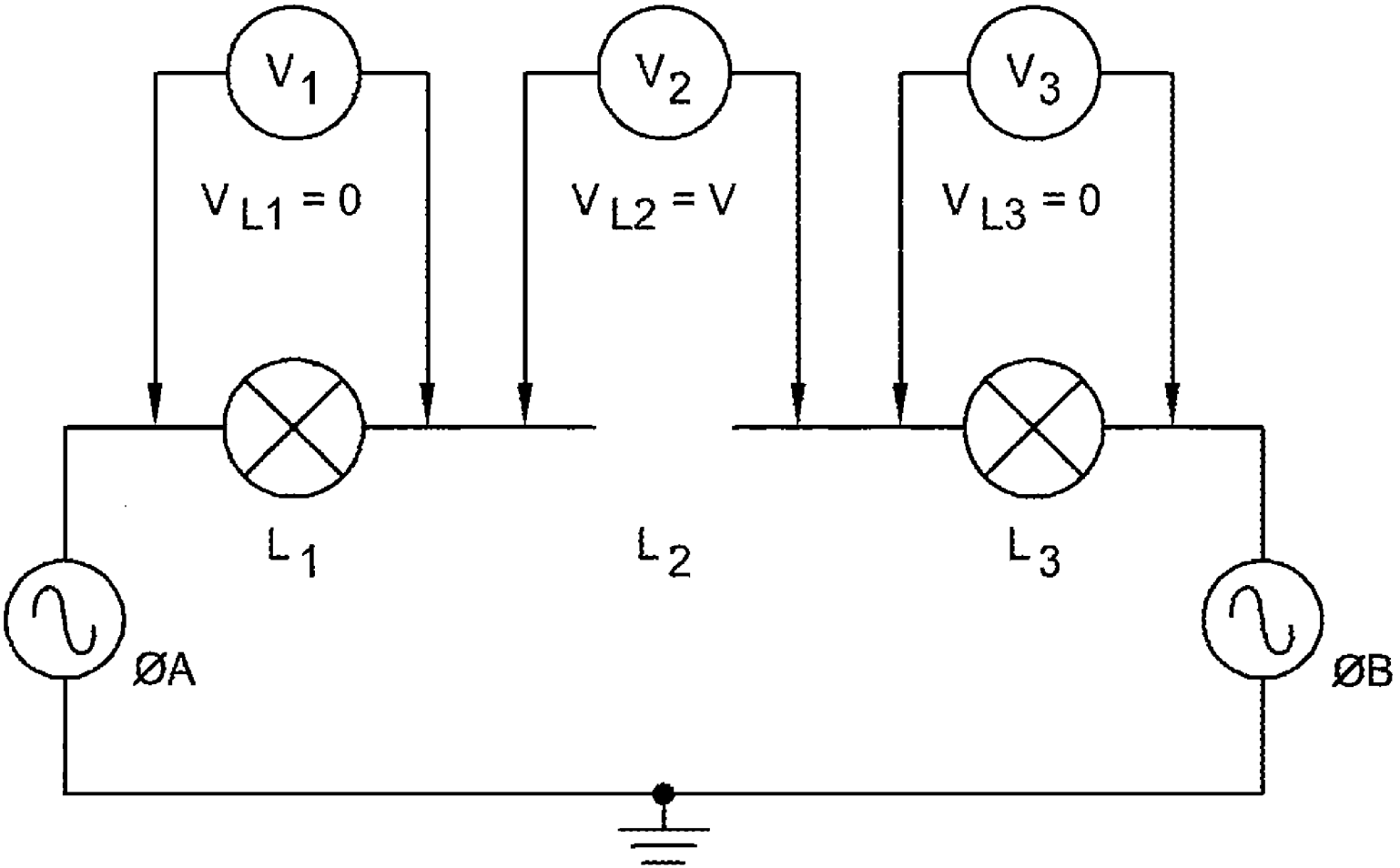

In FIG. 8B, lamp L2 is in an open state and all other lamps are in a closed state. An open state indicates that the internal lamp circuit is open and no current can flow through the lamp. The voltages across L1 and L3 are zero since there is no longer a complete circuit to allow current flow through the lamps. But since all the lamps are closed except for L2, the voltage measured across L2 will now have the value V which is the voltage applied to the three-lamp series. This condition can be generalized to three or more lamps in series, and expressed as: If all lamp voltages are zero except for one lamp that has a nonzero voltage, then the lamp with the nonzero voltage is open, has a voltage drop V, and all other lamps in the series are closed. A failure state for the open lamp exists, and a signal can be sent to a display screen to identify which lamp in the series has failed.

Figure 8C:
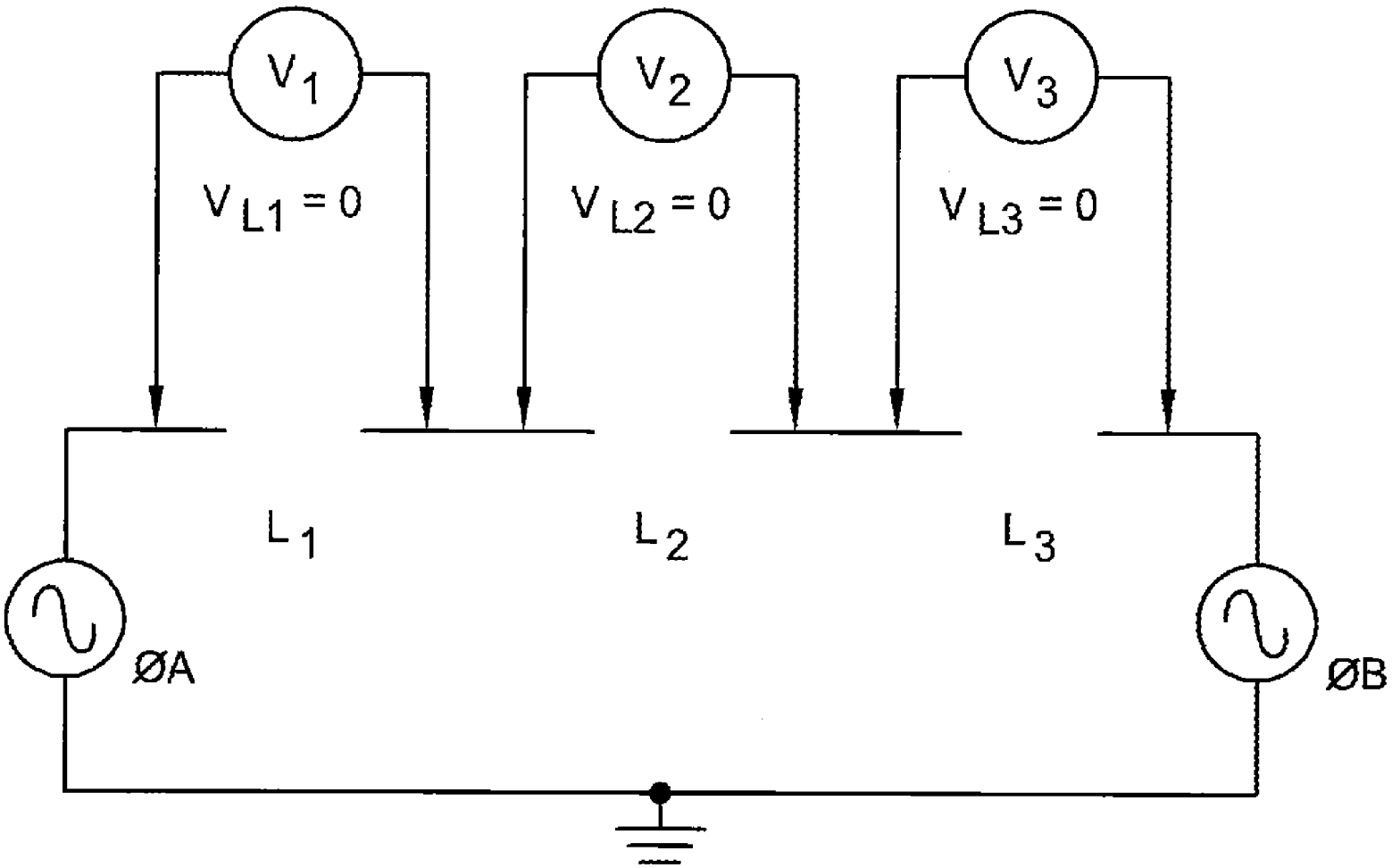
Figure 8D:
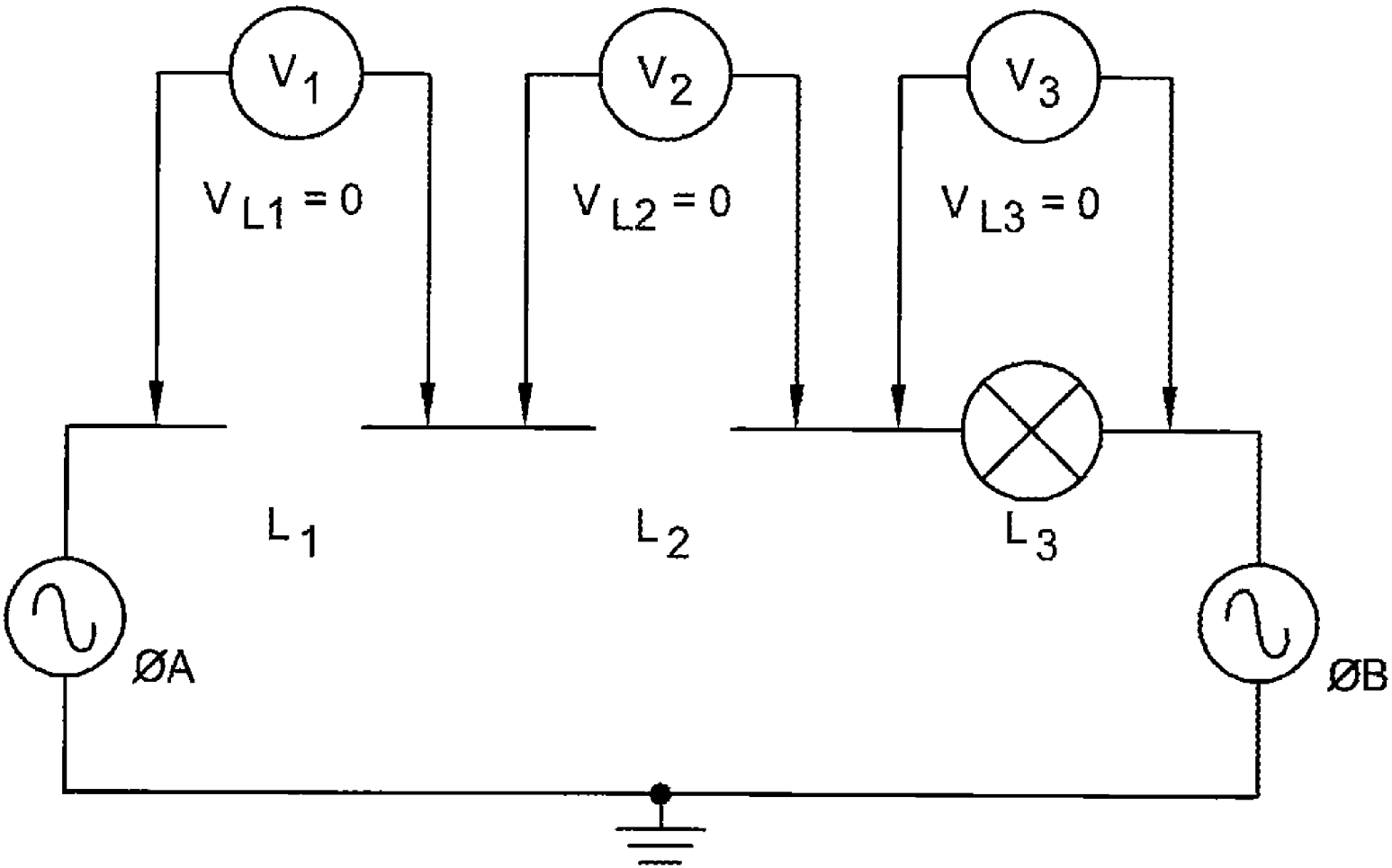

In FIG. 8C, all lamps are in an open state. As mentioned earlier, for some embodiments, the DAQ may be designed in the event of open circuits to provide zero voltage readings, as shown in FIGS. 8C and 8D. In this case, the voltages across each lamp are zero when all lamps are open, and a nonzero voltage value can only be obtained if a voltage measurement is made across the lamp series, in which case the value would be V. In other embodiments, the lamp failure detection system may be designed to indicate that an open circuit has been detected when all lamps are open, and not provide zero voltage readings. In FIG. 8D, only two lamps, L1 and L2, are open. When the series consists of three or more lamps, and more than one lamp is open, there may be insufficient information using only voltage drops across individual lamps to determine which lamps are open and which are not. The conditional in this case becomes: For three or more lamps in series, if the voltage drop across each lamp of the series is zero, then two or more lamps are in an open state.

Figure 8E:
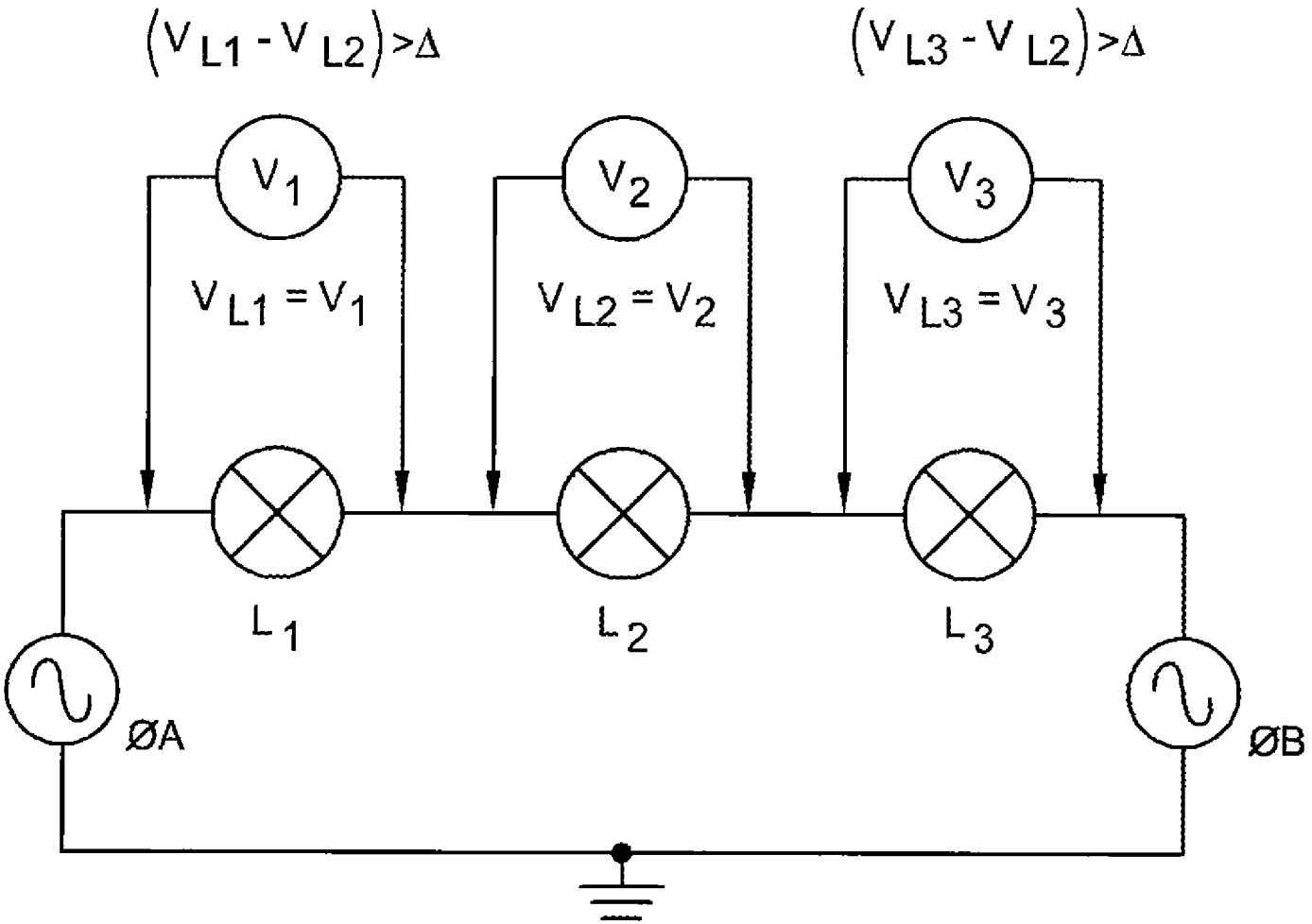

Another failure state is possible for the lamp series. FIG. 8E shows the case where lamp L2 has a partial internal short, and all the other lamps are normal. In this case none of the lamps are in an open state, and each lamp will have a nonzero voltage drop. It can be appreciated that a partial short in lamp L2 will reduce the lamp resistance below its normal value, and this will cause a decrease in the voltage drop across lamp L2. This observation suggests that a partial internal short in one lamp will increase the difference between voltage drops for each lamp beyond the value one would expect for normal lamp operation. This state can be represented by a conditional where the difference in voltages $V_{L1}$ and $V_{L2}$ are compared to a threshold value. If this difference exceeds the threshold value, then an unacceptable partial short condition is identified for lamp L2 and a failure state exists. This conditional can be expressed as: If all lamp voltages are nonzero, and $(V_{L1}-V_{L2})>\Delta$, then lamp L2 has a partial short. Note that in the case of three or more lamps, the other adjacent lamp could be used to test if lamp L2 has a short. Specifically, if $(V_{L3}-V_{L2})>\Delta$, then L2 would also be identified as having a short. The same methodology can be applied to any lamp in the series to test if the lamp is short. Additionally, the if-then statement can be further shortened to: If $(V_{L1}-V_{L2})>\Delta$, then lamp L2 has a partial short. In other embodiments, the failure detection method may also include the magnitudes of the voltage differences between non-adjacent lamp pairs. For example, if $(V_{L1}-V_{L3})>\Delta$, then lamp L3 has a partial short. As before, the choice of threshold value $\Delta$ will depend on the allowable variation in lamp intensities, but may be less than 8 percent of the average voltage across each lamp for application to RTP.

Figure 9:
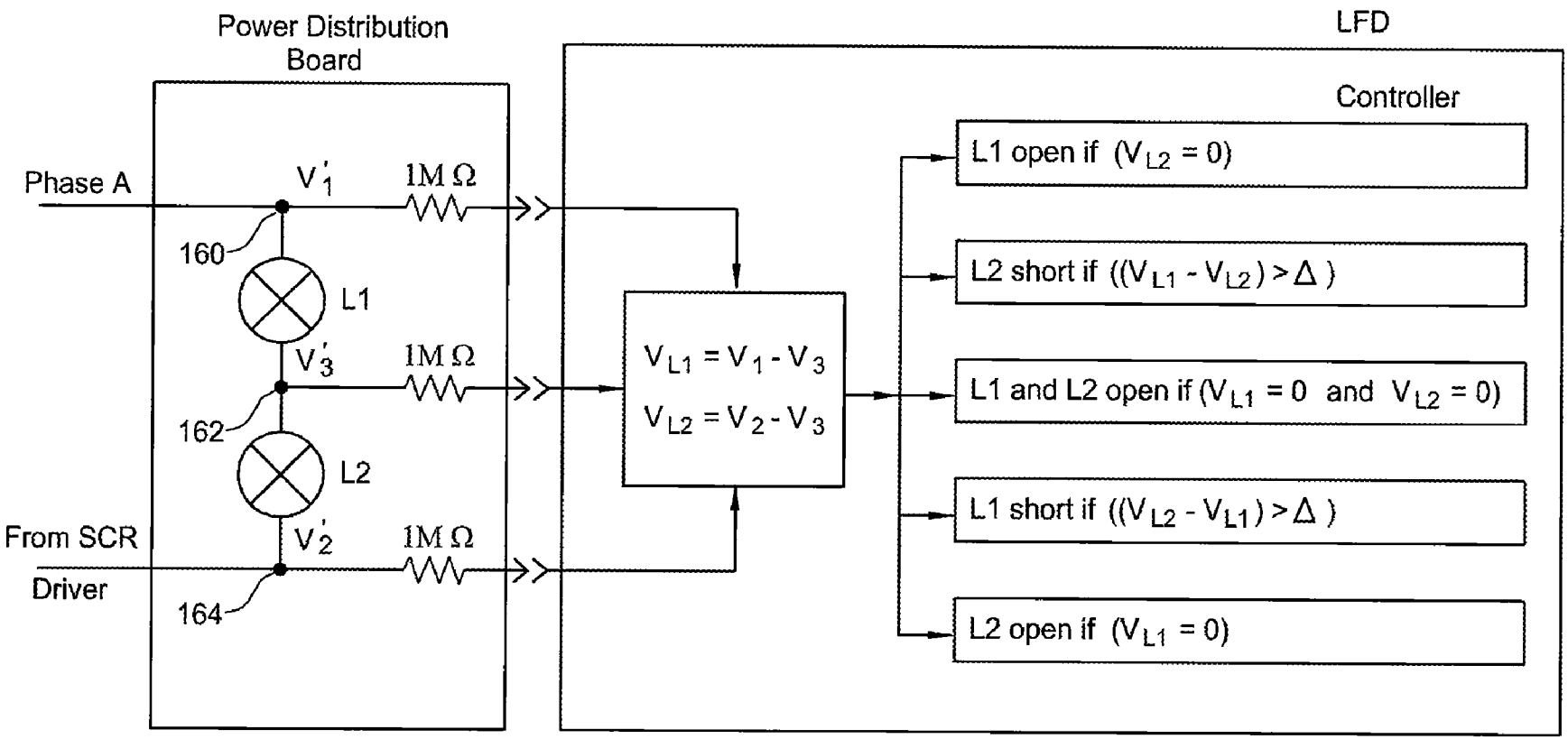
FIG. 9 is a schematic depiction of one embodiment of a lamp failure detection apparatus.

FIG. 9 is a schematic representation of the electronic components used to detect lamp failure for two lamps connected in series. An SCR driver is connected to a power distribution board that contains all the lamps in the lamphead. In this example, only a single pair is shown. All the lamps in the lamphead are divided into radially symmetric zones, and each zone is connected to a separate SCR driver so that power can be adjusted to each zone. Each zone is divided into lamp pairs, and each pair is connected to a failure detection system. One such lamp pair L1 and L2 is shown here.

The power distribution board has conducting lines that connect to points on either side of each lamp so that voltage measurements can be made at points on either side of the lamps. $V'_1$, $V'_2$, and $V'_3$ represent the analog voltages at points 160, 162, and 164 respectively, and $V_1$, $V_2$, and $V_3$ represent the corresponding digital values. Each conducting line has a ballast resistor of approximately 1 Mega-ohm. Although the present embodiment shows a ballast resistor of about 1 Mega-ohm, other resistance values may be used. In this embodiment, ballast resistors are included in the power distribution board, but may be included in the lamp failure detection (LFD) board in other embodiments.

The lamp failure detection (LFD) board includes a DAQ module and a controller module. The controller calculates the voltage drops across each lamp using the digital voltage values $V_1$, $V_2$, and $V_3$. The voltage drop across L1 is $V_{L1}=V_1-V_3$; the voltage drop across L2 is $V_{L2}=V_2-V_3$. Then the controller applies the conditionals shown in the figure to determine if a lamp failure state exists. If a lamp is open or has an internal short, the controller sends a signal to a user interface device that will allow the failure state to be detected and the failed lamp to be identified. In the present embodiment, as shown in FIG. 9, the lamp failure detection system is designed in the event of open circuits to provide zero voltage readings. In other embodiments, the system may only indicate that an open circuit has been detected, in which case the conditional for all lamps open as shown in FIG. 9 may no longer be relevant.

Figure 10A:
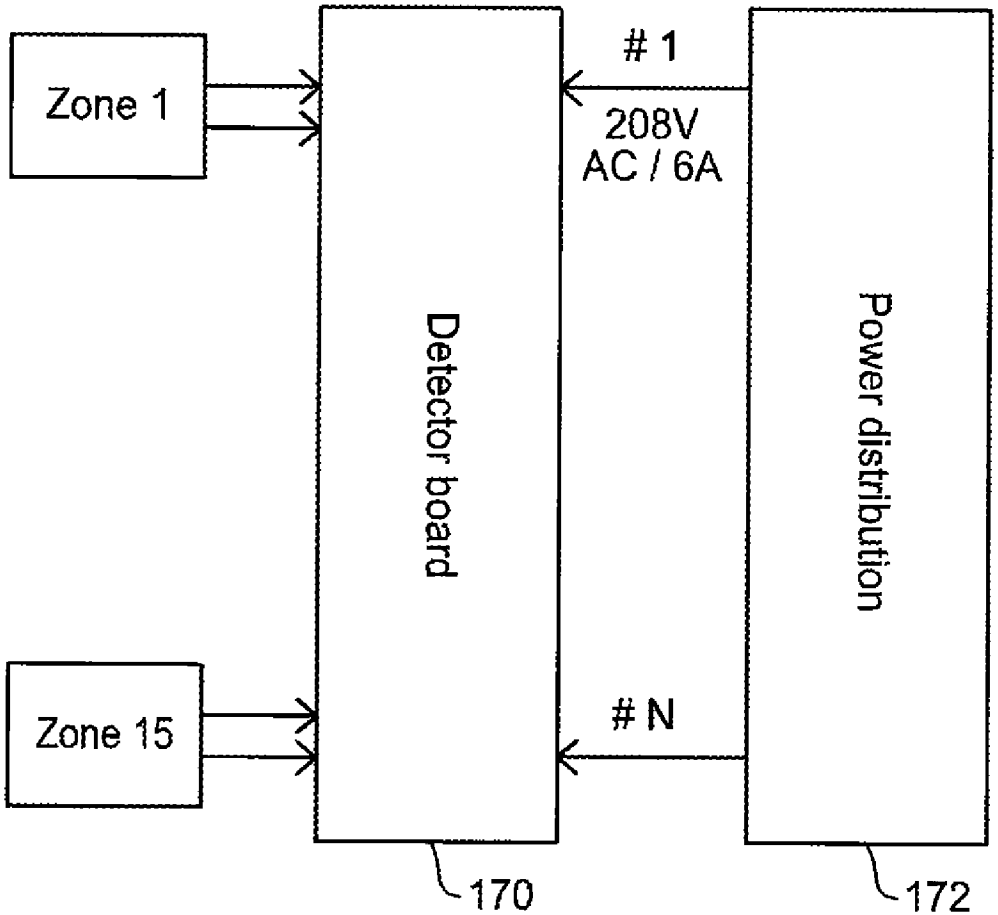
FIG. 10A (PRIOR ART)
FIG. 10A is a schematic view of a prior art lamp failure detection apparatus.
Figure 10B:
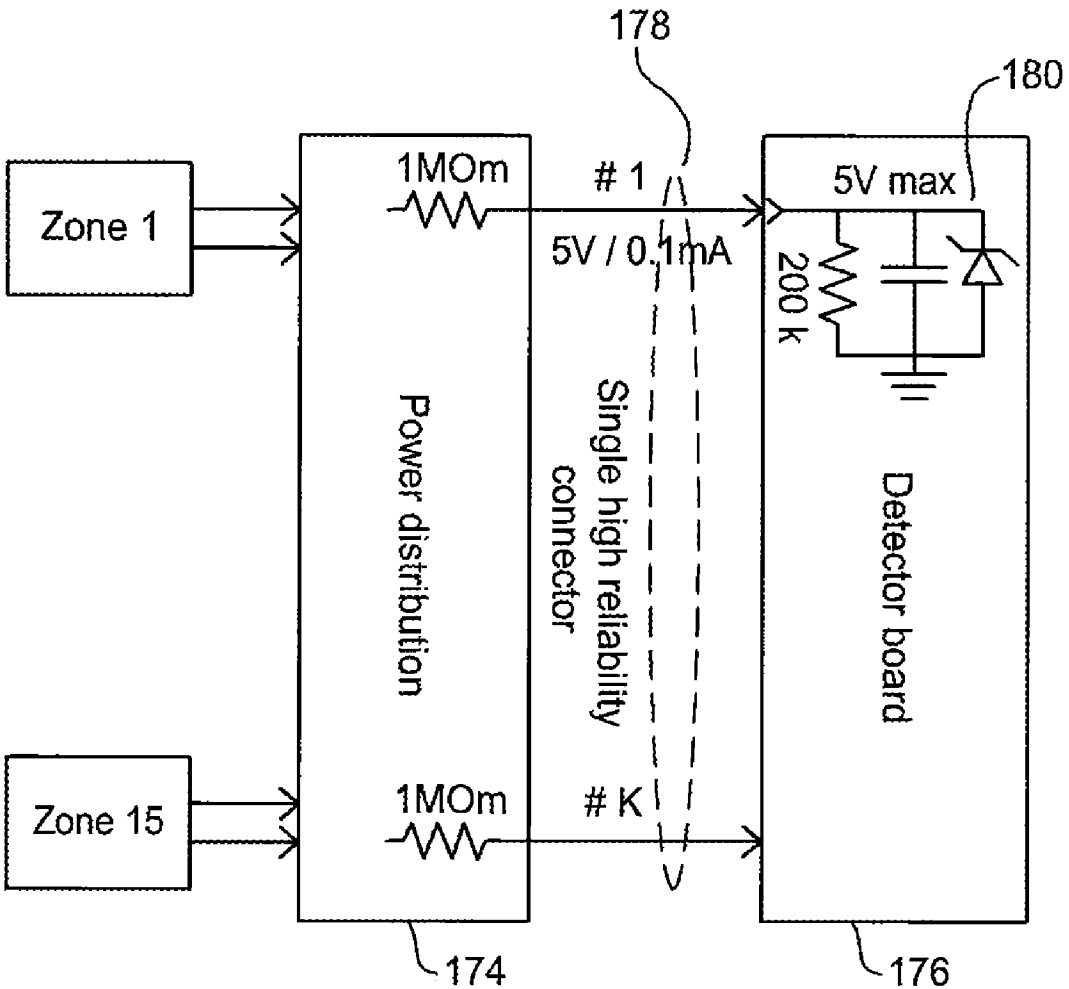
FIG. 10B is a schematic view of another embodiment of a lamp failure detection apparatus.

FIG. 10A is a schematic view of a prior art lamp failure detection apparatus, and FIG. 10B is a view of an embodiment of the present invention. A comparison of both figures shows the differences in connection methods between the LFD board and the power distribution board. Fifteen zones are shown, and each zone contains an SCR driver. Although 15 zones are shown in FIG. 10B, a different number of zones may be used in other embodiments of the present invention. In the prior art example, each zone and the associated driver are connected to the lamp failure detection (LFD) board 170, and the LFD board is connected to the power distribution (PD) board 172. The connection of the LFD board 170 to the PD board 172 requires the alignment of many different connectors, and this is a time consuming process. Also, this configuration requires that the LFD board 170 be present before any power can be delivered to the PD board 172 and lamps therein. Referring to FIG. 10B, the present embodiment shows a different connection configuration. The SCR driver in each zone is connected directly to the PD board 174 so that the PD board 174 and lamps therein can be operational without the LFD board 176. A single connector 178 will allow the PD board 174 and LFD board 176 to be connected together, greatly simplifying the connection of the two boards. In addition, the voltage signals received by the LFD board 176 will be to about 5V and about 0.1 mA due to the ballast resistor of approximately 1 Mega-Ohm. A filter circuit 180 may limit the signal voltage to about 5V maximum which is seen by the LFD board.

Figure 11:
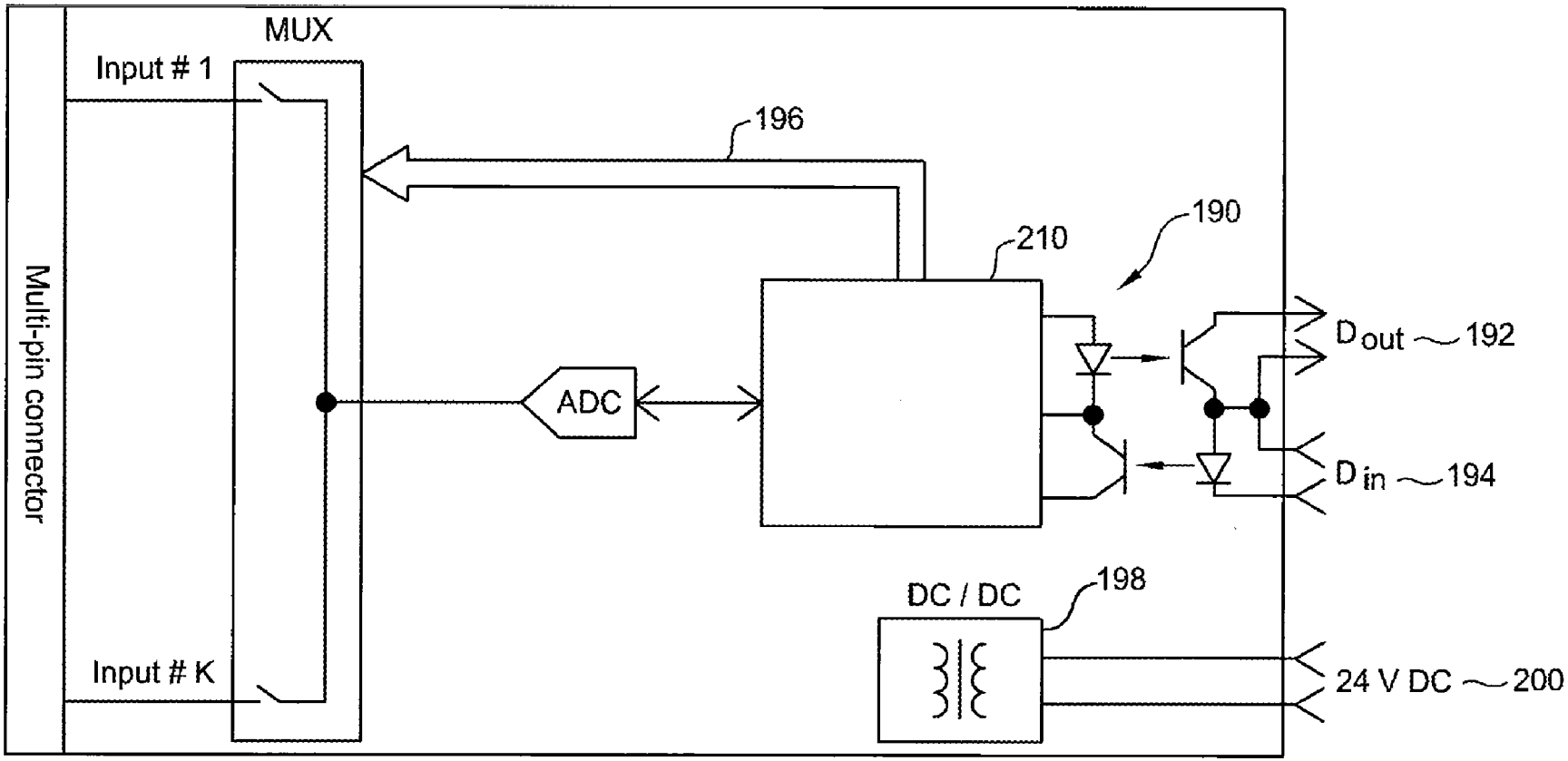
FIG. 11 is a schematic representation of an embodiment for a lamp failure detector board.

In FIG. 11, the structure of an embodiment of a LFD board of the present invention is shown in more detail. A multi-pin connector will allow the LFD board to connect to the power distribution board. Voltage signals from each lamp pair in each lamp zone will be input into a multiplexer (MUX) which will sample these signals as instructed via a communication channel 196 by a processor 210. The ADC will convert the analog signals to digital values that will be sent to a processor 210. In the present embodiment, a field programmable gate array (FPGA) is used for the processor, but other processors may be used. The FPGA may calculate the voltage drops across each lamp of each lamp pair. The FPGA will be preprogrammed with the lamp failure conditionals, and will apply these conditionals to determine if a lamp is in an open state or has an internal short. A DC/DC converter 198 is shown as part of the LFD board. A 24V DC power input 200 will be stepped down by the DC to DC converter to provide power to the LFD components. Input/output circuitry 190 will allow communication with the FPGA, as represented by data in $D_{IN}$ 194 and data out $D_{OUT}$ 192.

In the preceding embodiments of the present invention, two or more lamps in series have been considered. In some applications, it may be desirable or necessary to connect only one lamp across a power supply. For example, if the total number of lamps in the lamphead is an odd number, but lamp pairs are to be used as the basic series unit for each failure detection circuit, then a single lamp would remain unpaired. The failure detection method using voltage drops across each lamp cannot be used in the single lamp case unless the detection circuit is slightly modified, or an alternate method is used. The following lamp failure detection method deals with this single lamp case.

Figure 12:
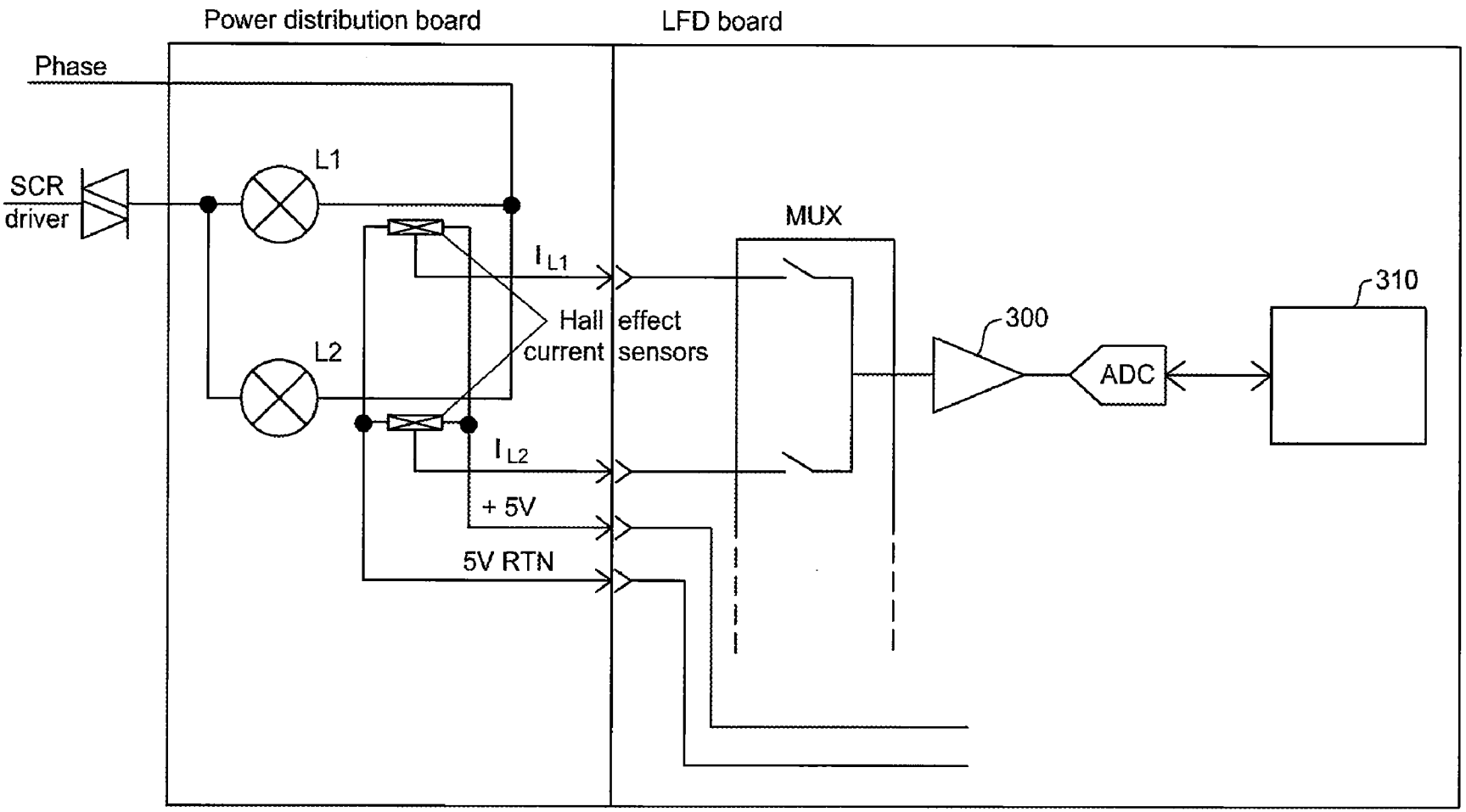
FIG. 12 depicts another embodiment of a lamp failure detection system.

FIG. 12 shows how a lamp failure detection method may be used in the case where a lamp cannot be placed in series with one or more additional lamps. Two lamps L1 and L2 are connected in parallel to a power supply, such as the SCR driver shown which may represent one zone of a plurality of radially symmetric zones in the lamphead. Each lamp is singly connected across the power supply. Hall effect current sensors are located in proximity to each lamp within the power distribution board. Current output signals $I_{L1}$ and $I_{L2}$ are sent to an LFD board and multiplexer (MUX) which can sample the signals and send them to an ADC to convert the analog signals to digital. The digital signals can then be sent to a processor 310, such as a field programmable gate array (FPGA), which can apply an if-then statement to the current signals to determine if lamp L1 or L2 is in a failure state. The if-then statement may simply be a threshold current value β that is compared to the current signal of each lamp. For example, if $I_{L1}<\beta$, then a failure state may exist for lamp L1. Since the current output signals may be very weak, one or more amplifiers 300 may be included in the LFD board to boost the signals, and the lamp failure if-then statement may be applied to the amplified signal.

The preceding embodiments of the present invention describe a lamp failure detection method and associated apparatus. This failure detection method would typically be applied prior to rapid thermal processing (RTP) of the wafer to help ensure that any lamps in an open or shorted state would be detected before wafer processing to avoid undesirable process results. However, to avoid reducing RTP system throughput and minimize system downtime, the failure detection method may be applied at different times and in different ways during system operation. In one such embodiment, the failure detection apparatus may only check for open lamps just prior to the start of the RTP cycle for each RTP chamber. Checking only for open lamps would take less time than checking for both open and shorted lamps, but open lamps will typically have a greater impact on radiation uniformity than lamps which are only partially shorted. The lamp failure detection method for open lamps would typically be performed with the lamps energized at a low percentage of maximum power, such as 10-20% of maximum power, for example. This period of low lamp power may also coincide with loading of the wafer into the RTP chamber, or shortly after wafer loading.

Figure 13:
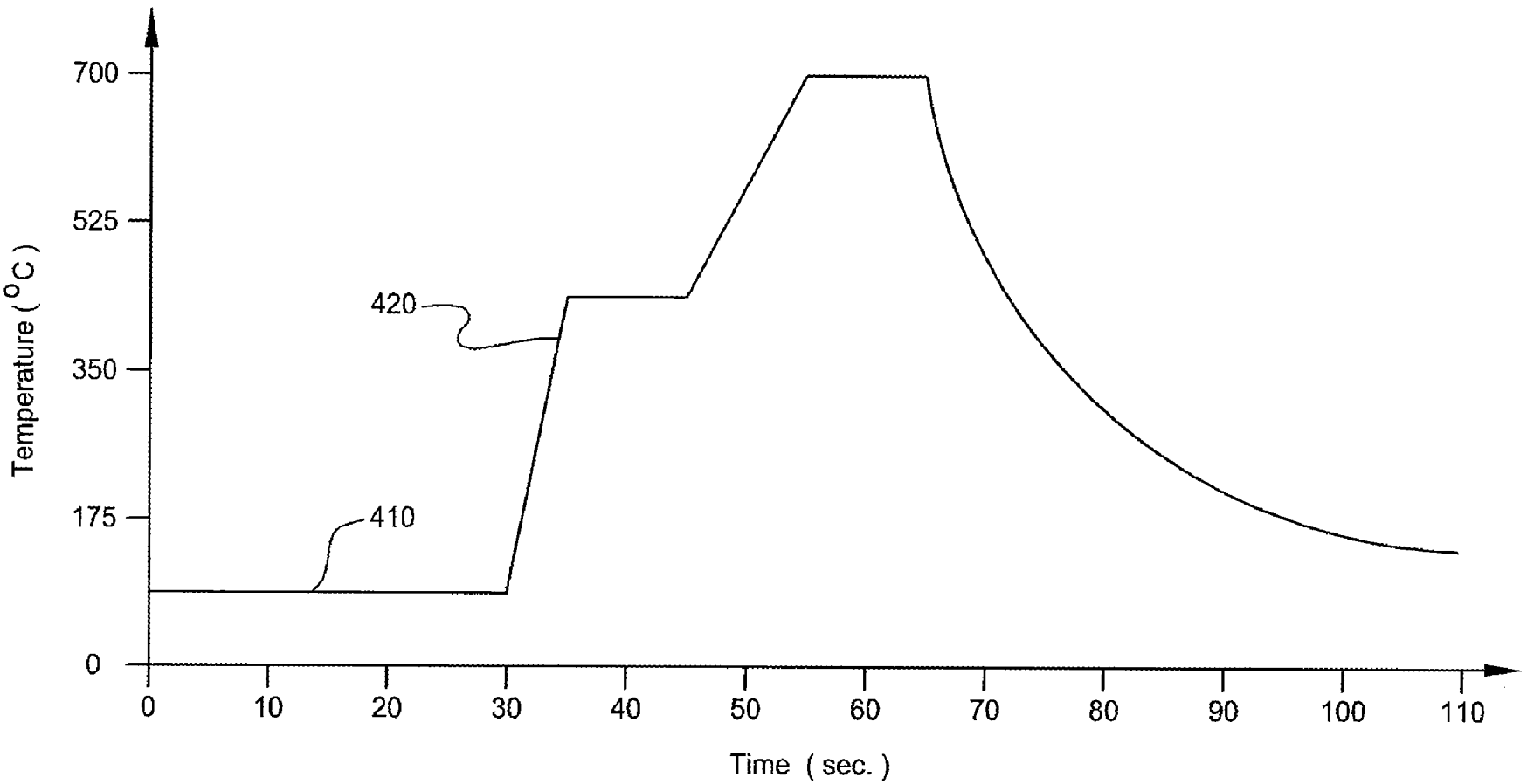
In FIG. 13, a typical time versus temperature curve for a rapid thermal processing (RTP) system is shown.

FIG. 13 shows a typical RTP time versus temperature curve. The temperature plateau 410 represents lamps which are energized but at a very low power setting, just prior to the start of an RTP cycle. The start of the RTP cycle is represented by the temperature ramp 420. The detection method for open lamps may be applied at such a temperature plateau 410, or during a very slow temperature ramp. The lamp failure detection apparatus can check each lamp of the lamphead for an open state in a sufficiently short time interval to allow application of the detection method just prior to start of the RTP cycle for each RTP chamber. Failure detection for lamps which may be shorted may be performed at less frequent intervals, possibly once or twice per day, and when there would be no impact to chamber throughput. In other embodiments, the lamp failure detection method could be performed during scheduled maintenance of the RTP system.

The lamp failure detection method may also be used to adjust thermal processing parameters for substrate processing based on lamp failure information. In one embodiment, the detection method for shorted or open lamp states may be performed during substrate processing for those lamp zones most sensitive to variations in lamp intensity, and corresponding lamp power adjustments made using lamp failure signals in order to compensate for the effects of failed lamps. In other embodiments, the power to different lamp zones may be changed, or different process parameters may be changed before, during, or after substrate processing to compensate for failed lamps.

The invention claimed is:

1. A lamp failure detection apparatus for detecting lamp failure in an array of lamps used for thermal processing of semiconductor substrates, comprising:

a data acquisition (DAQ) module to sample voltage signals at different sampling locations along a circuit path formed by a group of serially connected lamps in the array; and a controller adapted to detect a failure in one or more of the lamps based on voltage drops across at least two of the lamps, as determined by the sampled voltage signals.

2. The apparatus of claim 1, wherein the group of serially connected lamps comprises more than two lamps.

3. The apparatus of claim 1, wherein the controller is adapted to detect an open circuit condition of a first one of the lamps based on a zero voltage drop across a second one of the lamps.

4. The apparatus of claim 1, wherein the controller is adapted to detect a partial short of a first one of the lamps if the voltage drop across the first lamp is less than a voltage drop across a second one of the lamps by more than a threshold amount.

5. The apparatus of claim 1, wherein the controller is adapted to detect an open circuit condition of multiple of the lamps based on a zero voltage drop across each of one or more lamps.

6. The apparatus of claim 1, wherein the DAQ module provides the controller with a digital value of the sampled voltage signals.

7. The apparatus of claim 1, wherein the sampled voltage signals are alternating current (AC) voltage signals.

8. A lamp failure detection system for detecting lamp failure in an array of lamps used for thermal processing of semiconductor substrates, comprising:

a multiplexor for receiving a plurality of analog voltage signals sampled from different locations along circuit paths formed by groups of serially connected lamps in the array;

an analog to digital (AID) converter to provide digital values corresponding to one or more of the analog voltage signals output by the multiplexor; and control logic adapted to control the multiplexor to select which analog voltage signals are output by the multiplexor and, for multiple groups of serially connected lamps in the array, to detect a failure in one or more of the lamps of the group based on voltage drops across at least two of the lamps, as determined by the sampled voltage signals.

9. The apparatus of claim 8, wherein the control logic is implemented in a field programmable gate array (FPGA).

10. The apparatus of claim 8, wherein the control logic is implemented as a micro controller.

11. The apparatus of claim 8, further comprising a communication interface allowing an external device to communicate with the control logic to receive lamp failure detection data.

12. The apparatus of claim 8, wherein the control logic is adapted to control the multiplexor to sequentially select multiple groups of serially connected lamps in a common zone.

13. The apparatus of claim 8, wherein the groups of serially connected lamps comprise more than two lamps.

14. The apparatus of claim 8, wherein the controller is adapted to detect an open circuit condition of a first one of the lamps based on a zero voltage drop across a second one of the lamps.

15. The apparatus of claim 8, wherein the controller is adapted to detect a partial short of a first one of the lamps if the voltage drop across the first lamp is less than a voltage drop across a second one of the lamps by more than a threshold amount.

16. The apparatus of claim 8, wherein the lamps are tungsten halogen lamps.

17. A method for detecting lamp failure in an array of lamps used for thermal processing of semiconductor substrates, comprising:

sampling voltage signals at different sampling locations along a circuit path formed by a group of serially connected lamps in the array;

calculating voltage drops across at least two of the lamps based on the sampled voltage signals; and determining the presence or absence of a failure based on a relationship between the voltage drops, wherein the determining the presence or absence of a failure based on a relationship between the voltage drops comprises, at least:

determining an existence of an open circuit condition of a first one of the lamps based on a zero voltage drop across a second one of the lamps; and determining an existence of a partial short of a first one of the lamps if the voltage drop across the first lamp is less than a voltage drop across a second one of the lamps by more than a threshold amount.

* * * * *